United States Patent [19]

Kamaike

[11] Patent Number: 4,685,538

[45] Date of Patent: Aug. 11, 1987

[54] REMOTE CALL REGISTRATION SYSTEM FOR ELEVATOR

[75] Inventor: Hiroshi Kamaike, Inazawa, Japan

[73] Assignee: Mitsubishi Denki Kabushiki Kaisha, Tokyo, Japan

[21] Appl. No.: 849,949

[22] Filed: Apr. 9, 1986

[30] Foreign Application Priority Data

Apr. 10, 1985 [JP] Japan ..... 60-75880

[51] Int. Cl.[4] ..... B66B 1/14

[52] U.S. Cl. ..... 187/121

[58] Field of Search ..... 187/29 R, 121, 130; 340/19 R, 20, 21, 696

[56] References Cited

U.S. PATENT DOCUMENTS 4,355,309 10/1982 Hughey et al. ..... 340/696 X
4,600,087 7/1986 Tsuji ..... 340/20 X

FOREIGN PATENT DOCUMENTS 54-124462 9/1979 Japan .
55-44456 3/1980 Japan .
58-197163 11/1983 Japan .

*Primary Examiner*—William M. Shoop, Jr.
*Assistant Examiner*—Richard K. Blum
*Attorney, Agent, or Firm*—Leydig, Voit & Mayer

[57] ABSTRACT

A remote call registration system for an elevator including a transmitting device carried by a user and a receiving device disposed at a position near to but spaced a distance from the elevator hall. A signal transmitted from the transmitting device is received by the receiving device when the user is at a given walking distance from the elevator hall and sent to a call registration device to register the call prior to arrival of the user at the elevator hall. The distance between the receiving device and the elevator hall is predetermined to be substantially equal to the walking distance corresponding to a mean waiting time required for the cage to arrive at the hall after the call is registered by the call registration device. Thus, the user's waiting time at the elevator hall is substantially reduced.

7 Claims, 7 Drawing Figures

REMOTE CALL REGISTRATION SYSTEM FOR ELEVATOR

BACKGROUND OF THE INVENTION

This invention relates to a remote call registration system for an elevator in which, a call is automatically registered prior to arrival of a user and to reduce the waiting time of the user, the call is automatically registered when the user has come to a hall.

Various call registration means have heretofore been considered for the elevators of hotels, especially for the purpose of enhancing service to hotel guests who have baggage. For example, as disclosed in Japanese Patent Application Laid-Open No. 58-197163, respective ultrasonic detectors for ascent and for descent are disposed in the ceiling of an elevator hall, and calls are automatically registered for persons waiting under the ultrasonic detectors. Thus, the passengers can enter the cages without being required to lower and lift the baggage in the hall.

Such a method, however, has had disadvantages listed below.

(1) In the hall, only the up and down calls are registered. Therefore, the user needs to register a destination floor in the cage anew and must lower and lift the baggage.

(2) The call is registered for the first time when the user has come to the elevator hall. Therefore, the user must wait for 20 - 30 seconds till the arrival of the cage after the registration of the call, resulting in the situation in which he/she gets tired and must lower the baggage.

SUMMARY OF THE INVENTION

This invention, solves such problems, and has for its object to provide a remote call registration system for an elevator with which at the same that, or before, a user comes to an elevator hall in a lobby or the like, the cage of the elevator can arrive to eliminate the waiting time of the user, and with which the user can go to a destination floor without any manipulation in both the hall and the cage.

The remote call registration system for an elevator according to this invention is so constructed that a call is registered when a receiving device spaced a distance from an elevator hall, such as the entrance of the elevator hall, has received a transmission signal from a transmitting device operated by a user.

In this invention, when the user has come within a predetermined distance from a doorway for cage, the receiving device located within the distance senses the transmission signal, whereupon a call is registered.

BRIEF DESCRIPTION OF THE DRAWINGS

In the drawings, the same symbols indicate identical or corresponding portions.

DESCRIPTION OF THE PREFERRED EMBODIMENT

Figure 1:
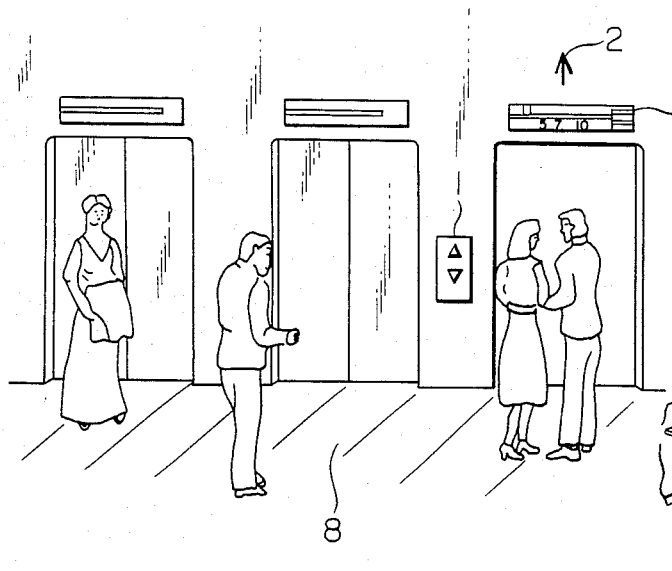
FIG. 1 is a front view of an elevator hall to which an embodiment of a remote call registration system for an elevator according to this invention is applied.

Now, an embodiment of a remote call registration system for an elevator according to this invention will be described with reference to the drawings. FIG. 1 is a front view of an elevator hall to which the embodiment is applied, while FIG. 2 is a plan view thereof.

Figure 2:
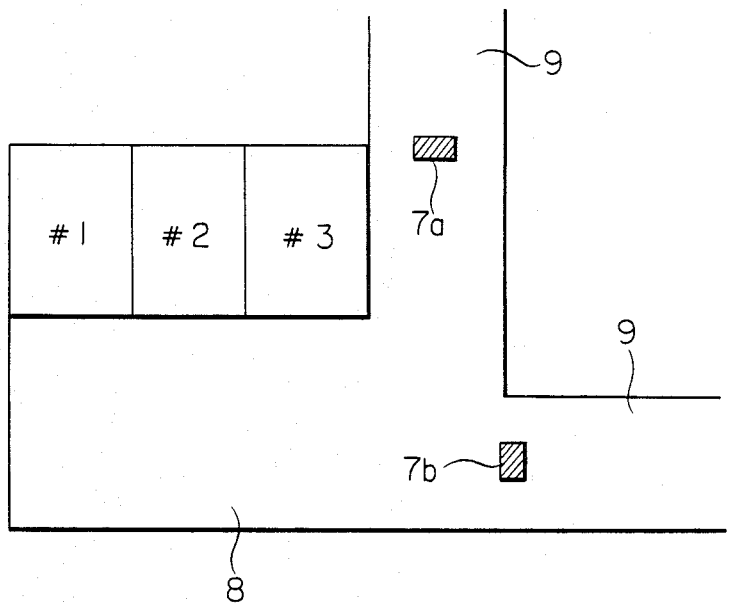
FIG. 2 is a plan view of the elevator hall in FIG. 1.

As seen from both FIGS. 1 and 2, the elevator system includes cages No. 1 - No. 3 indicated by 1 - 3 respectively. In the elevator hall, hall call buttons 1 are disposed on the hall wall between the hoistways of the cages No. 2 and No. 3 as shown in FIG. 1. These hall call buttons 1 are for general passengers.

Hall lanterns 2 are provided at upper parts of the hall. The hall lantern 2 indicates the first arriving cage and the direction thereof.

Indicators 3 are disposed under the hall lanterns. The indicator 3 indicates the scheduled arrival floors of the corresponding cage. For example, it displays in the illustration of FIG. 1 that the cage is scheduled to arrive at the fifth floor, seventh floor and tenth floor.

Figure 1A:
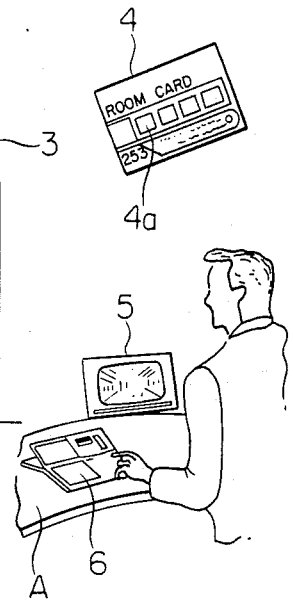
FIG. 1A is a perspective view showing the appearance of a transmitting device in this invention.

Specified passengers who use the elevator possess transmitting devices. As an example of the transmitting device, a card 4 with a transmitter as shown in FIG. 1A is used.

The card with the transmitter 4 has a plurality of button switches 4a arrayed thereon, and serves also as the key of a room in a hotel. In the illustrated example, room No. 253 is exhibited. In this case, a signal is transmitted so as to register a call for the second floor.

In addition, when the button switch 4a is depressed, it is turned 'on' to start oscillation and to send a signal.

On the other hand, a reception office A is arranged in the elevator hall 8. A CRT 5 as a display device for monitoring and a control panel 6 are installed on the desk of the reception office A. When the button of the control panel 6 is depressed, a switch SW2 shown in FIG. 5 turns 'on', and receiving devices 7a and 7b provided in the ceilings of passageways 9 leading to the elevator hall 8 as illustrated in FIG. 2 operate.

The receiving device 7a or 7b is disposed at a position near to but spaced a distance from the elevator hall in a passageway leading to the hall to receive a signal transmitted from the transmitter 4 which is operated when the user is at a given walking distance from the elevator hall so that the period of time a person takes to walk to the elevator hall 8 is substantially equal (the mean waiting time required for a cage of the elevator) to arrive at the hall after the call is registered.

Figure 3:
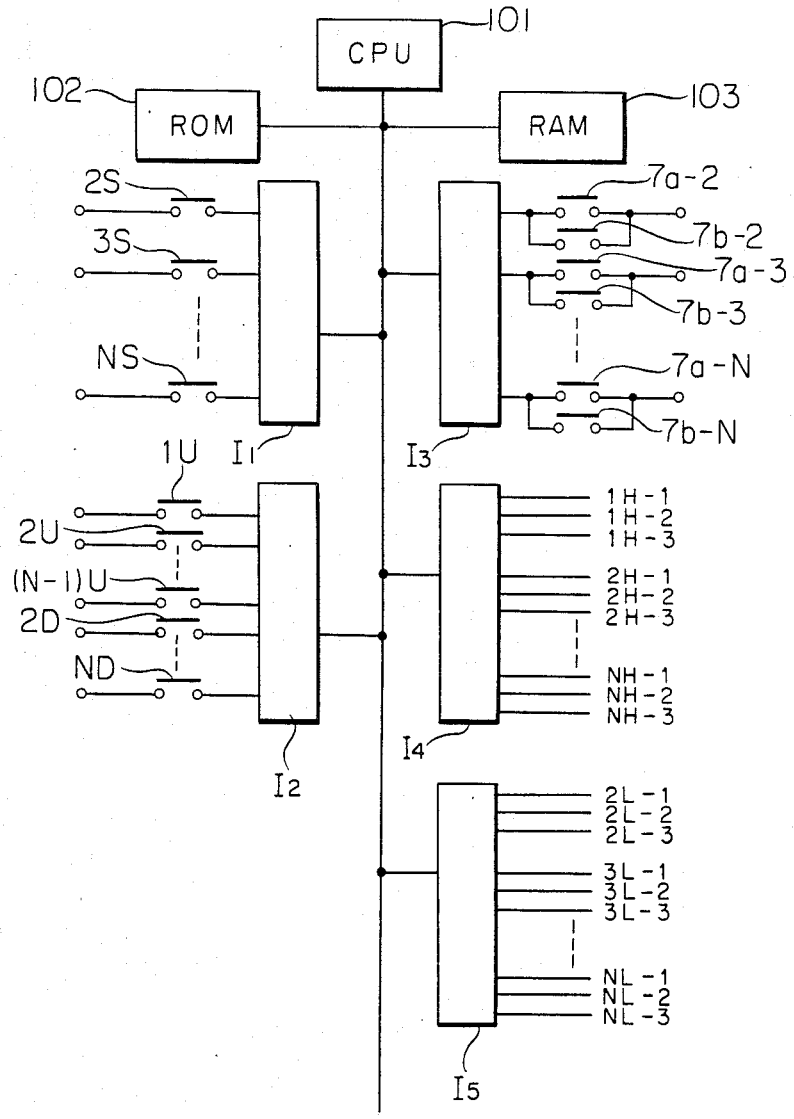
FIG. 3 is a block diagram of a control apparatus in the remote call registration system for an elevator according to this invention.

FIG. 3 is a block diagram showing a control apparatus for the elevator. In the apparatus of FIG. 3, calls are respectively fed into a CPU 101 through interfaces I1 and I2 by means of ordinary cage call switches 2S, 3S, ... NS and hall up call switches 1U, 2U, ... (N - 1)U as well as hall down call switches 2D, ... ND.

Besides, the control apparatus has a circuit which automatically registers destination floors when the receiving devices 7a and 7b have received the transmission signals from the cards with the transmitters 4. That is, signals from the output relay contacts 7a-2 thru 7b-N of the receiving devices 7a and 7b are fed into the CPU 101 through an interface I3.

Further, in this control apparatus of FIG. 3, lamps 1H-1 (a hall lantern lamp for the cage No. 1 on the first floor) thru NH-3 (a hall lantern lamp for the cage No. 3 on the N-th floor) for the hall lanterns 2 which display the cages assigned to the calls are connected to the CPU 101 through an interface I4.

Likewise, the control apparatus includes lamps 2L-1 (a lamp for the call of the second floor assigned to the cage No. 1 and registered) thru NL-3 (a lamp for the call of the N-th floor assigned to the cage No. 3 and registered) for the indicators 3 which serve to display the calls of floors registered in the respective cages. These lamps 2L-1 thru NL-3 are connected to the CPU 101 through an interface I5.

A ROM 102 and a RAM 103 are respectively connected to the CPU 101.

Figure 4:
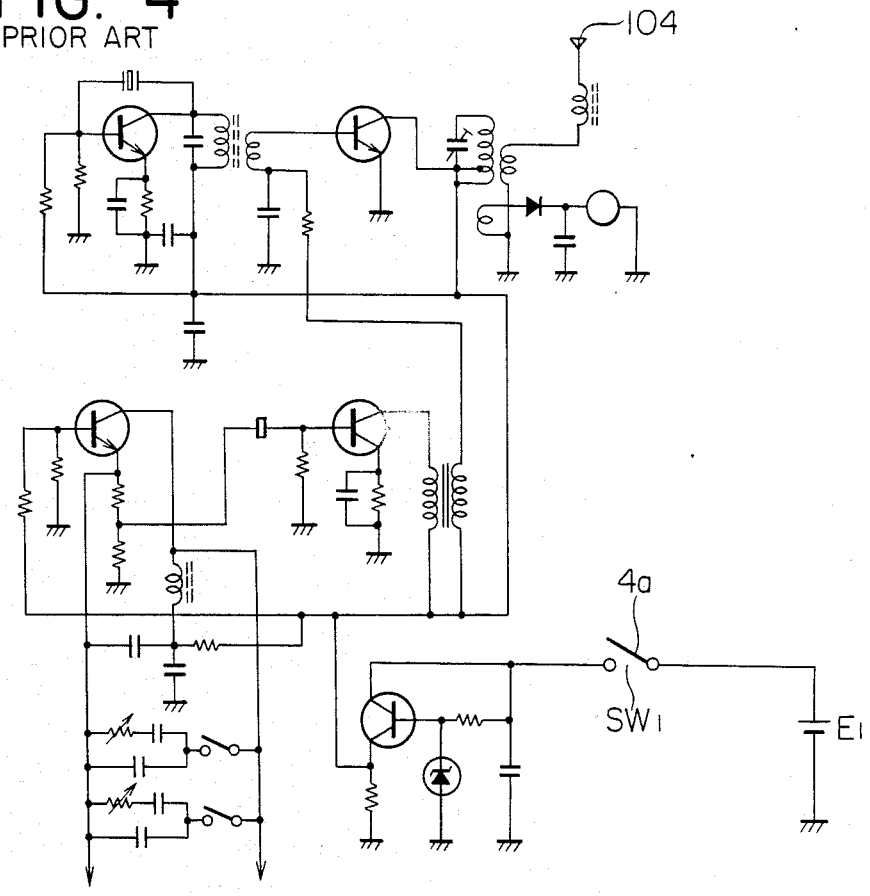
FIG. 4 PRIOR ART
FIG. 4 is a circuit diagram showing the transmitting device which is applied to the remote call registration system for an elevator according to this invention.

FIG. 4 shows a transmitting circuit which is built in the card with the transmitter 4. When the button switch 4a is closed, a power source E1 is operatively connected, and the oscillating operation is started to send the transmission signal from an antenna 104. The frequencies of such transmission signals differ depending upon the individual cards with the transmitters 4, and correspond to the destination floors.

Figure 5:
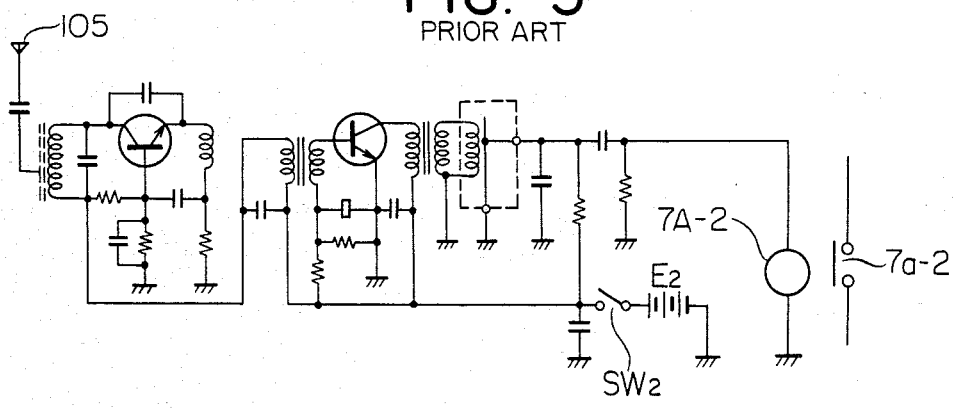
FIG. 5 PRIOR ART
FIG. 5 is a circuit diagram of a receiving device which is applied to a remote call registration system for an elevator according to this invention.

FIG. 5 is a circuit diagram showing the internal arrangement of the receiving device 7a or 7b. When the switch SW2 referred to before is turned 'on' through the manipulation of the control panel 6, a power source E2 is operatively connected to make the reception possible.

The receiving devices are installed in numbers corresponding to the floors. For example, in the case of the illustrated embodiment, the two sets of 7a and 7b are provided for each of the second to N-th floors, and they receive the signals of the corresponding floor. For example, in the case of the receiving device shown in FIG. 5, a relay 7A-2 is energized to close its relay contact 7a-2 when a person carrying the card with the transmitter 4 for the second floor has passed the place of the receiving device 7a. Then, the relay contact 7a-2 shown in FIG. 3 is closed, and the call of the second floor is automatically registered by call registration means including the CPU 101.

Figure 6:
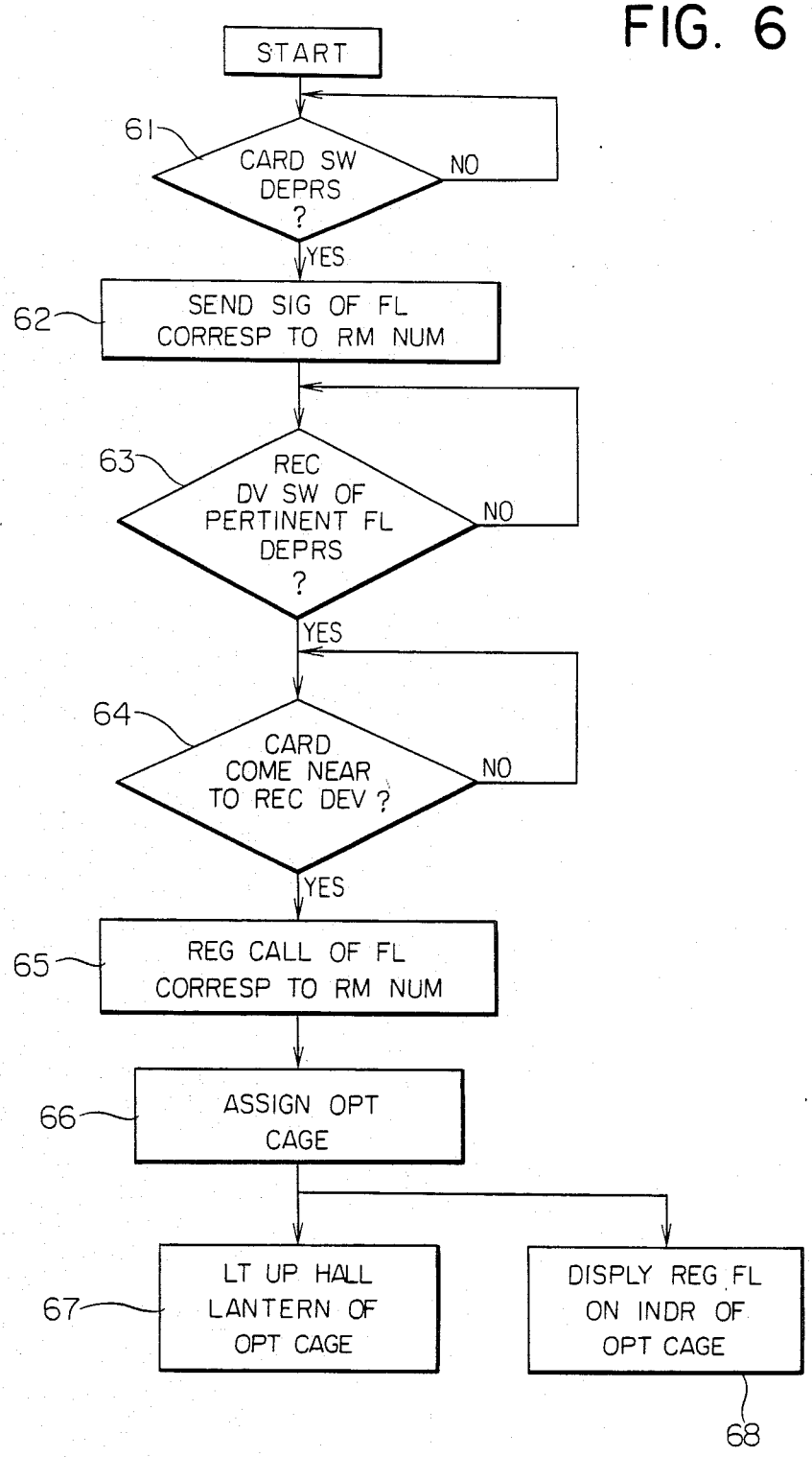
FIG. 6 is a flow chart showing the flow of the operations of the remote call registration system for an elevator according to this invention.

Next, the operation of the remote call registration system for the elevator according to this invention will be described in conjunction with a flow chart in FIG. 6. First, when the button switch 4a of the card with the transmitter 4 is depressed at a step 61, the power source E1 of the transmitting device shown in FIG. 4 is operatively connected, and this transmitting device starts operating. At a step 62, the transmission signal of a floor corresponding to room No. (in this case, the second floor because of the room No. 253) is sent from the antenna 104.

Next, the button of the control panel 6 of the reception office A is depressed at a step 63, whereby the switch SW2 of the receiving device in FIG. 5 is turned 'on' to operatively connect the power source E2. In this way, the receiving devices 7a and 7b fall into their operating states.

Subsequently, when the possessor of the card with the transmitter 4 has come near to the receiving device 7a or 7b, the transmission signal sent from the transmitting device of the card with the transmitter 4 is received by the antenna 105 of the receiving device to energize the relay 7A-2 at a step 64. Thus, the contact 7a-2 of this relay is closed.

Upon the closure of the contact 7a-2, the receiving device 7a is connected with the CPU 101 through the interface I3. When the person carrying the card with the transmitter 4 has passed the installed place of the receiving device 7a, the destination call of the second floor has already been registered at a step 65. This call of the second floor is allotted to the optimum cage at a step 66. The hall lantern 2 of the cage with the call registered therein is lit up (a step 67), while at the same time the indicator 3 displays the registered floor (a step 68). It is needless to say that, at this time, a hall call for calling the cage to the hall is conjointly registered by the call registration means including the CPU 101.

The above embodiment has exemplified the case where the call is fed into the CPU 101 for the first time when the person to get in the cage has come to the installed place of the receiving device 7a (or 7b) near the elevator hall 8. Since, however, it is foreknown that the person will go to the elevator hall, it is also possible that, at the stage at which the card has been delivered to the person at the reception office, the delivery be supplied to the CPU 101 as information. Also in this case, the final call registration is done when the person has come near to the elevator hall.

While this invention has been described as to the case of disposing the system on only the first floor which includes the main floor, similar systems can also be disposed on the other floors.

As described above, this invention is so constructed that the call of a destination floor is automatically registered by means of a transmitting device carried by an elevator user and a receiving device installed near an elevator hall. The user can, therefore, go to the destination floor without depressing a button in the hall or in a cage and without significant waiting in the hall.

What is claimed is:

1. A remote call registration system for an elevator comprising a portable transmitting device to be carried by a user of the elevator, a receiving device disposed at a position near to but spaced a distance from a hall of the elevator in a passageway leading to the hall to receive a signal transmitted from said transmitting device when the user is at a given walking distance from the elevator hall, and call registration means to register a call prior to arrival of the user at the elevator hall responsive to said receiving device receiving the transmitted signal to reduce the waiting time when the user has arrived at the elevator hall.

2. A remote call registration system for an elevator comprising a portable transmitting device to be carried by a user of the elevator, a receiving device disposed at a position near to but spaced a distance from a hall of the elevator in a passageway leading to the hall to receive a signal transmitted from said transmitting device when the user is at a given walking distance from the elevator hall, and call registration means to register a call prior to arrival of the user at the elevator hall responsive to said receiving device receiving the transmitted signal to reduce the waiting time when the user has arrived at the elevator hall, said transmitting device sending a signal representing a destination floor determined for each of the elevator users.

3. A remote call registration system for an elevator comprising a portable transmitting device to be carried by a user of the elevator, a receiving device disposed at a position near to but spaced a distance from a hall of the elevator in a passageway leading to the hall to receive a signal transmitted from said transmitting device operated when the user is at a given walking distance from the elevator hall, and call registration means to register a call prior to arrival of the user at the elevator hall responsive to said receiving device receiving the transmitted signal to reduce the waiting time when the user has arrived at the elevator hall, said call registration means registering a destination hall and a hall call in response to said receiving device receiving the transmitted signal.

4. A remote call registration system for an elevator comprising a portable transmitting device to be carried by a user of the elevator, a receiving device disposed at a position near to but spaced a distance from a hall of the elevator in a passageway leading to the hall to receive a signal transmitted from said transmitting device when the user is at a given walking distance from the elevator hall, and call registration means to register a call prior to arrival of the user at the elevator hall responsive to said receiving device receiving the transmitted signal to reduce the waiting time when the user has arrived at the elevator hall, the distance said receiving device is spaced from the elevator hall being substantially equal to the walking distance corresponding to a mean waiting time required for a cage of the elevator to arrive at the hall after a call is registered by said call registration means.

5. A remote call registration system for an elevator comprising a portable transmitting device to be carried by a user of the elevator, a receiving device disposed at a position near to but spaced a distance from a hall of the elevator in a passageway leading to the hall to receive a signal transmitted from said transmitting device operated when the user is at a given walking distance from the elevator hall, and call registration means to register a call prior to arrival of the user at the elevator hall responsive to said receiving device receiving the transmitted signal to reduce the waiting time when the user has arrived at the elevator hall, said receiving device being installed in a passageway leading to a hall of only a main floor of a multi-story building.

6. A remote call registration system for an elevator comprising a portable transmitting device to be carried by a user of the elevator, a receiving device disposed at a position near to but spaced a distance from a hall of the elevator in a passageway leading to the hall to receive a signal transmitted from said transmitting device when the user is at a given walking distance from the elevator hall, and call registration means to register a call responsive to said receiving device receiving the transmitted signal prior to arrival of the user at the elevator hall to reduce the waiting time of the user at the elevator hall, and arrival preannouncement means disposed in the elevator hall and operated by said call registration means to announce a cage responding to a call before arrival at the elevator hall.

7. A remote call registration system for an elevator as defined in claim 6 further comprising destination display means disposed in the hall and operated to display a floor corresponding to a registered destination call.

* * * * *